United States Patent [19]

Ramirez

[11] Patent Number: 4,836,801

[45] Date of Patent: Jun. 6, 1989

[54] MULTIPLE USE ELECTRICAL CONNECTOR HAVING PLANAR EXPOSED SURFACE

[75] Inventor: Ronald A. Ramirez, Damascus, Md.

[73] Assignee: Lucas Weinschel, Inc., Gaithersburg, Md.

[21] Appl. No.: 8,374

[22] Filed: Jan. 29, 1987

[51] Int. Cl.[4] ..... H01R 13/62

[52] U.S. Cl. ..... 439/322; 439/349; 439/665

[58] Field of Search ..... 439/585, 284, 289, 290, 439/291, 292, 293, 295, 349, 350, 351, 363, 352; 285/913, 330

[56] References Cited

U.S. PATENT DOCUMENTS

| | | | |
|---|---|---|---|
| 2,710,763 | 6/1955 | Gilbert | 285/330 |
| 2,757,351 | 7/1956 | Klostermann | 439/583 |
| 3,091,748 | 11/1959 | Takes et al. | 339/65 |
| 3,529,278 | 7/1968 | Bishop | 339/130 |
| 3,680,034 | 7/1972 | Chow et al. | 439/289 |
| 3,683,320 | 8/1972 | Woods et al. | 339/177 E |
| 3,725,849 | 4/1973 | Becke | 439/363 |
| 3,876,277 | 4/1975 | Colwell | 339/130 C |
| 3,915,539 | 10/1975 | Collins | 439/363 |
| 3,955,871 | 5/1976 | Kruger | 439/363 |
| 3,994,552 | 11/1976 | Selvin | 439/289 |
| 4,043,629 | 8/1977 | Brannen | 339/126 J |
| 4,060,298 | 11/1977 | Gearin | 285/913 |
| 4,066,324 | 1/1978 | Stephens | 339/126 J |
| 4,125,308 | 6/1982 | Schilling | 339/171 C |
| 4,440,464 | 4/1984 | Spinner | 339/33 |
| 4,441,781 | 4/1984 | Forney et al. | 339/177 R |
| 4,734,050 | 3/1988 | Negre et al. | 439/824 |

*Primary Examiner*—David Pirlot

*Attorney, Agent, or Firm*—Hall, Myers & Rose

[57] ABSTRACT

An electrical connector which can be panel or in-line mounted, and accommodates coaxial, waveguide, or mono-conductor cables. The connector is comprised of two separable halves which mate to form continuous electrical connections. One connector half presents a planar surface carrying two electrically conductive zones, the other connector half carries spring biased electrically conductive protrusions for contact with the zones of the first half to create intimate electrical continuity between the two halves.

2 Claims, 3 Drawing Sheets

Fig. 4
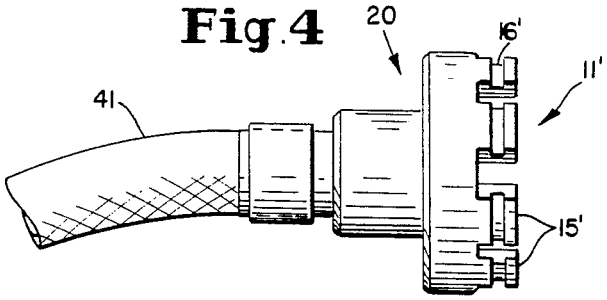
Fig. 5B
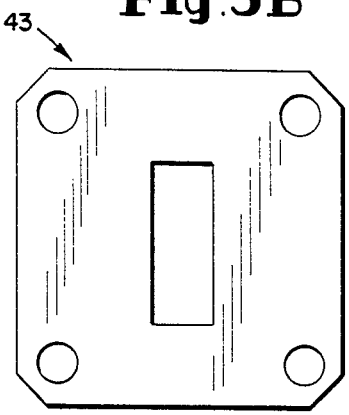
Fig. 5A
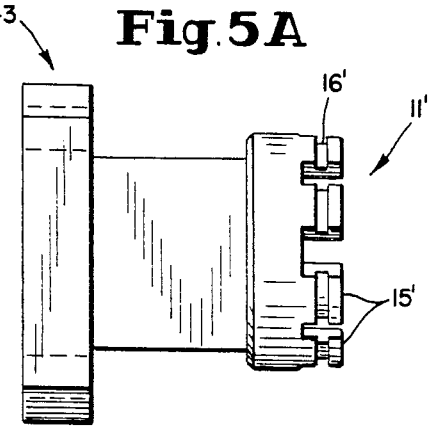
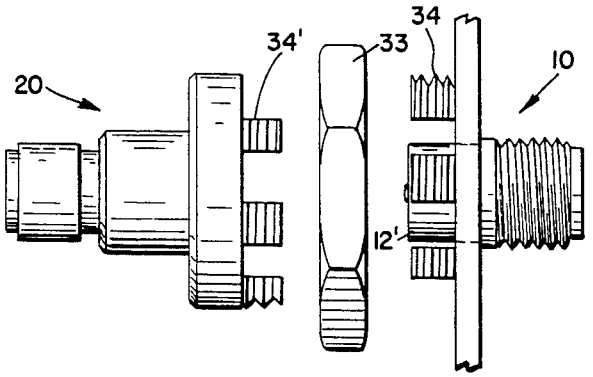
Fig. 8
Fig. 9
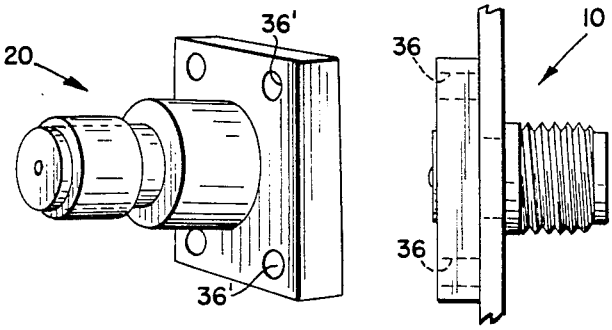

MULTIPLE USE ELECTRICAL CONNECTOR HAVING PLANAR EXPOSED SURFACE

BACKGROUND OF THE INVENTION

The present invention relates to electrical connectors. More particularly, the present invention relates to coaxial or waveguide electrical connectors which are configured for easy coupling and replacement of variously-sized and configured connectors.

Many forms of electrical and electromagnetic wave transmission lines are needed to convey signals within the electromagnetic spectrum. The physical dimensions of the transmission medium are dictated by the requirements of the signal being carried. As the physical requirements of the transmission line change so do the physical requirements of connectors utilized to establish transmission continuity across various junctures. The prior art required different connectors to accomodate different signal carrying requirements dictated by different signals. Problems arose because each half of a connector was configured for receipt of only one specific size and mating configuration, thereby severely limiting the range of frequencies or signals which could be inputed to or outputed from the connector. This problem arises with both panel-mounted connectors and transmission cable in-line connectors where physical requirements necessitate attachment of multiple sizes and styles of mating connector halves.

As higher frequencies need to be accomodated, the physical dimensions of connectors necessary to handle such frequencies have to be increasingly smaller. When the desired frequency is very high, especially above 18 GHz, the physical dimension of connectors becomes extremely small. Connectors which are small enough to accomodate signals above 18 GHz are inherently delicate and easily susceptible to damage. Prior to the present invention, damage of a panel mounted electrical connector from external trauma meant that the entire connector had to be removed from thepanel and replaced with a new connector. This necessitated the recalibration of instruments to accommodate the substituted connector.

The prior art offered no means for quick replacement of all or half of a damaged connector, and failed to offer replacement without the need for recalibration.

SUMMARY OF THE INVENTION

It is an object of the present invention to provide a flush mounted connector base capable of accommodating various external connector members requiring replacement due to damage, wear or the need for a different connector style.

It is a further object of the present invention to provide a connector which can carry a wide range of signals over the electromagnetic spectrum through the accommodation of working connectors having widely divergent physical characteristics.

It is yet another object of the present invention to provide a connector; having one member that is replaceable with members of differing physical dimensions to accommodate differing signal requirements.

It is a further object of the invention to provide a connector which allows for the quick replacement of one of the connector members without the need for recalibration.

It is a further object of the invention to protect the integrity of the center sheath of a coaxial structure by providing a means for avoiding potential damage caused by the center conductor of a coaxial line extending outwardly from the instrument or apparatus with which the instrument is associated.

It is a further object of the present invention to provide rigidly-engageable connector halves which are resistant to rotational torques when properly engaged for electrical continuity.

It is yet another object of the present invention to provide a connector which provides environmental protection of the contact surfaces and reduction of RF leakage in the zone of the connection.

It is still a further object of the present invention to provide a connector half which presents a minimal profile upon disconnection of the other half of the connector, thereby minimizing potential damage to the exposed first mentioned half of the connector.

It is another object of the invention to provide a two part connector which can be panel or in-line mounted.

It is yet another object of the present invention to provide a two-part high frequency connector of adequate size and complexity to enable the connector to be formed through operation of a single screw machine.

The above and further objects of the present invention are satisfied by a two part connector constructed as taught in the specification herein. The connector has a first half permanently mounted to a panel or conductive line, having an exposed conductive-contact-bearing face. The second half of the connector has a front face for mating with the conductive surfaces of the first half, and a body configured for proper transmission of the desired signal.

The connector halves are quickly engageable and disengageable. The engaged connector provides a means for proper alignment and good continuity of connection. The connector of the present invention also greatly reduces the potential of damage to the mounted portion of the connector from external trauma.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

FIG. 4 is a side view of an alternative embodiment of the working half of the present invention configured for transmission of SMA signals.

FIGS. 5A and 5B are a side view and end view of a wave guide configured spring-biased-contact-bearing connector half.

FIG. 8 is a simplified side view of the two halves of the present invention, illustrating an alternative retention means.

FIG. 9 is a simplified sideview of the two halves of the present invention, illustrating an alternative retention means.

DETAILED DESCRIPTION OF THE PREFERRED EXEMPLARY EMBODIMENTS

Figure 1:
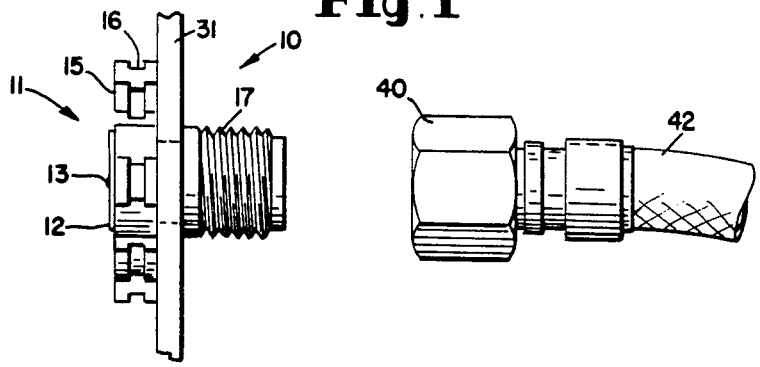
FIG. 1 is a side view of the planar-contact-bearing connector half mounted on a panel.
Figure 6:
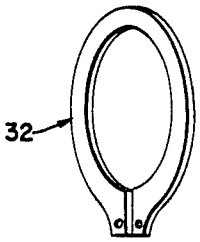
FIG. 6 is a perspective view of the spring clip utilized to maintain the engagement of the connector halves.
Figure 2:
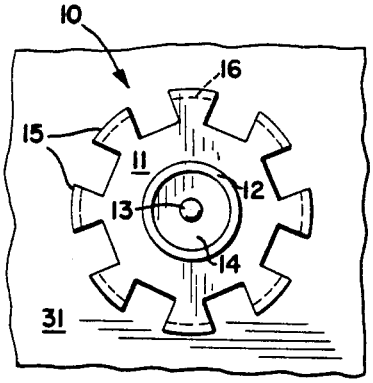
FIG. 2 is a front view of the planar-contact-bearing connector half of the present invention, mounted to a panel.
Figure 3:
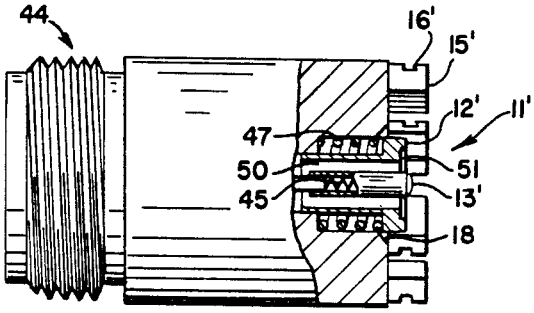
FIG. 3 is a cut away side view of the spring-biased-contact-bearing working half of the present invention.
Figure 7:
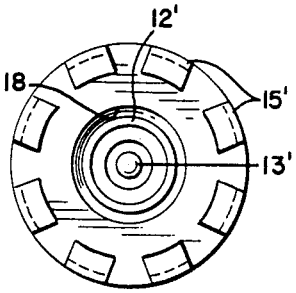
FIG. 7 is an end view of the spring-biased-contact-bearing face of the present invention.

The present invention in the prefered embodiments illustrated herein is comprised of two main parts, the mounted or base connector half 10 which bears planar-contact surfaces illustrated in FIGS. 1 and 2, and the working half 20, which bears spring biased contacts, illustrated in FIGS. 3, 4, 5 and 7. The working half 20 can be configured in any number of ways, three examples of which are illustrated in FIGS. 3, 4 and 5. The front face of each of these examples is configured as illustrated in FIG. 7.

The planar contact bearing connector half 10 as illustrated in FIGS. 1 and 2 is comprised of an exterior planar face 11 which contains contact surface 12, center conductor 13 and crown teeth 15. The connector half 10 also has a body portion 17, extending behind the panel 31, to which a cable 42 can be connected by means of securing nut 40. The contacts 12 and 13 are separated by a non-conductive plug 14 which surrounds the center conductor 13 along its entire length, thereby electrically isolating and supporting the center conductor 13 except at its ends. The interior end of conductor 13 is configured to accept the center conductor of a coaxial cable 42 or the direct mounting of electrical components which are properly configured for the body portion 17 of the connector. The exposed exterior face 11 is configured for electrical contact with spring biased center conductor 13' of the working connector half, 20.

FIG. 4 illustrates the working half 20 of the connector attached to a coaxial cable 41. This cable 41 is dimensioned to accommodate the transmission of a selected signal. The body of connector half 20 is also dimensioned for proper transmission of such desired signal. The front contact bearing face 11' is configured, as illustrated in FIGS. 3 and 7, with properly positioned spring biased contacts 12' and 13' and properly dimensioned crown teeth 15' for precise engagement with the crown teeth 15 of the face 11 of planar connector half 10 illustrated in FIG. 2.

The connector working half 20 as illustrated in FIGS. 5A and B is constructed as a wave guide with a back end 43, the face of which is illustrated in FIG. 5B, configured for attachment to an appropriate wave transmission line.

The working half 20 illustrated in partial cross-section in FIG. 3 is constructed with a standard SMA mating coupler 44 at its back end and therefore can accept any SMA transmission line which will accommodate appropriate coupling.

It is possible and contemplated by the present invention to construct the back or non-contact-bearing end of the working half of the connector of the present invention in any manner desired in order to accommodate a wide range of transmission lines.

The engagable face 11' of the connector interchangeable working half 20 as illustrated in FIGS. 3 and 7 has mating spring biased contact surfaces 12' and 13'. Conductors 13' and 12' are biased outwardly by springs 45 and 47 respectively. Interposed between conductors 12' and 13' is non-conductive zone 50, which can be either an air gap or a sleeve of non-conductive material. Ring 51 which surrounds conductor 13' towards its outer end is comprised of solid non-conductive material and can be composed of any appropriate dielectric. Spring 45 is in electrical contact with the center conductor of whatever cabling is attached to the back end of the interchangable connector half 20. Spring 47 maintains electrical contact between conductor 12' and the outer sheath of the cable.

Through interpositioning of the spring 45, between the center conductor of a cable and conductor 13', a self compensating mechanism is provided for accomodating cables with center conductors which extend to varying degrees beyond the end of the cable. This prevents conductor 13' from exerting undue force on contact 13, thereby preventing damage to components behind panel 31 which could otherwise result from the connection of cables with over-tolerance center conductors or from inadvertent impact on an external member 20 such as illustrated in FIGS. 3, 4 and 5.

Surrounding the outer conductor 12' is a groove 18 into which is seated a resilient "0" ring. When compressed between faces 11 and 11', the "0" ring provides protection for the contact surfaces from environmental factors such as moisture, dust and dirt. If the "0" ring is properly impregnated with electrically-conductive material, it will reduce RF leakage in the connection zone.

In the planar connector half 10, when configured for panel mounting as illustrated in FIGS. 1 and 2, only the exterior face 11 including crown teeth 15, extends beyond the surface of the panel 31. The planar connector half can also be line mounted, presenting the identical exposed planar surface without the panel mounting.

Figure 10A:
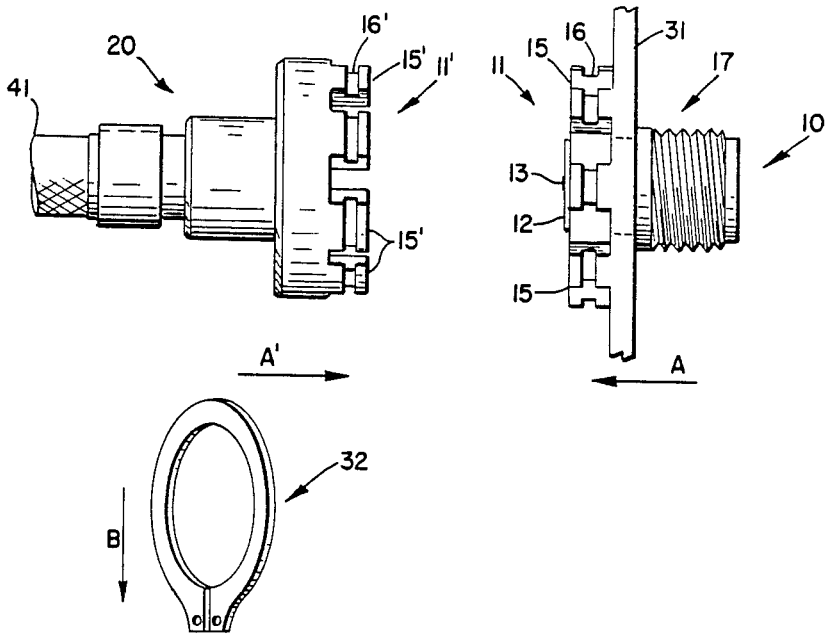
FIGS. 10A–C are side views of the two halves of the preferred embodiment of the present invention illustrating the process for engagement.
Figure 10B:
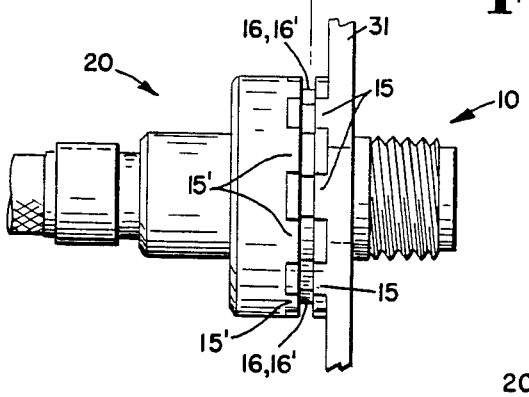
Figure 10C:
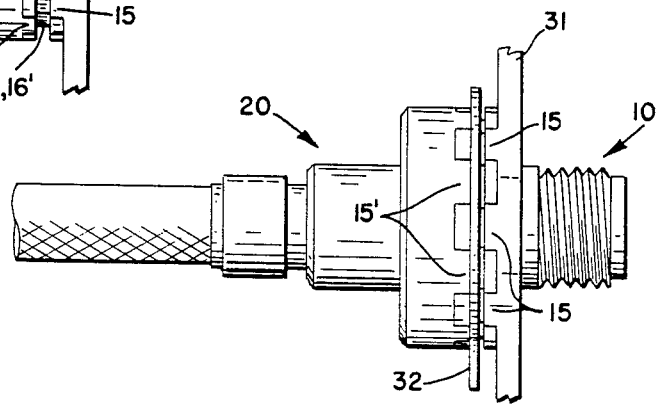

The sequence utilized to form a proper electrical connection of consistent contact integrity is illustrated in FIGS. 10A-C, wherein arrows A, A' or B indicate direction of relative movement of connector halves 10, 20 and spring clip 32 respectively. First the two halves 10 and 20 are aligned with faces 10 and 10' parallel and opposite each other, as illustrated in FIG. 10A. The two halves are then moved toward each other to interleave the crown teeth 15' of the interchangeable connector half 20 with the crown teeth 15 of the planer connector half 10 as illustrated in FIG. 10B. The two halves are urged toward each other until faces 11 and 11' are in intimate contact. The spring clip 32, as illustrated in FIGS. 10B and C, is engaged in the annular groove 16—16' on the exterior surfaces of the connector halves formed upon engagement.

With connector half 20 positioned in proper engagement with connector half 10, contacts 12 and 12' and contacts 13 and 13' are held in electrical contact by the force exerted by springs 45 and 47. Springs 45 and 47 independantly bias the exposed ends of conductors 12' and 13' toward contact surfaces 12 and 13 respectively.

The clip 32 engaged in the single continuous annular groove 16—16' formed by the mated crown teeth 15 and 15' of connector halves 10 and 20 acts to maintain continuous engagement of the two conductor halves.

Alternatively, the two halves 10 and 20 could have alignable threads 34 and 34', as illustrated in FIG. 8 in place of grooves 16 and 16' for maintaining engagement of the connector halves. In this embodiment, nut 33 would be utilized in place of spring clip 32.

The two halves 10 and 20 could be configured with flanges 35 and 35' as illustrated in FIG. 9, having corresponding holes 36 and 36'. When the two halves 10 and 20 are mated, holes 36 and 36′ are aligned. Bolts are passed through unthreaded holes 36′ and threaded into threaded holes 36 to secure the two connector halves 10 and 20 together.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. An improved high frequency signal line connector establishing a continuous transmission medium, comprising:

a first connector member having a first face, and a second connector member having a second face, wherein said first face is a low profile planar face, said first face having a first central conductor and a first outer ring shaped conductor coaxial with said first central conductor, said second face having a spring biased central conductor configured for electrical contact with said first central conductor, and a spring biased outer ring shaped conductor configured for electrical contact with said first outer ring conductor of said first face, and means for releasably coupling said first connector member to said second connector member, said means exerting forces on said members only perpendicular to said faces and preventing rotation of said members relative to one another, said means including said first face having a first set of regularly spaced projections about its outer periphery, said second face having a second set of regularly spaced projections about its outer periphery, said first radial projections being tightly interleaved with said second projections upon engagement of said first and second members to establish and maintain proper alignment of said conductors of said faces, said first set of projections and said second set of projections being provided with external threaded portions which align to form a continuous set of threads upon engagement of said sets of projections.

2. The connector of claim 1, wherein an internally threaded ring is provided for retention of interleavment of said first and second sets of projections by engagement with said continuous annular external threads.

* * * * *